US010401762B2

(12) United States Patent
Hoshi et al.

(10) Patent No.: US 10,401,762 B2
(45) Date of Patent: Sep. 3, 2019

(54) CARTRIDGE AND UNIT

(71) Applicant: CANON KABUSHIKI KAISHA, Tokyo (JP)

(72) Inventors: Nobuharu Hoshi, Yokohama (JP); Akira Suzuki, Naka-gun (JP); Hiroshi Takarada, Tokyo (JP); Toshiteru Yamasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/725,440

(22) Filed: Oct. 5, 2017

(65) Prior Publication Data

US 2018/0039206 A1 Feb. 8, 2018

Related U.S. Application Data

(62) Division of application No. 13/669,964, filed on Nov. 6, 2012, now Pat. No. 9,817,338.

(30) Foreign Application Priority Data

Nov. 9, 2011 (JP) ..... 2011-245733
Dec. 9, 2011 (JP) ..... 2011-270107

(51) Int. Cl.
*G03G 15/08* (2006.01)
*G03G 21/18* (2006.01)

(52) U.S. Cl.
CPC ..... *G03G 15/0898* (2013.01); *G03G 21/181* (2013.01); *G03G 2215/0872* (2013.01)

(58) Field of Classification Search
None
See application file for complete search history.

(56) References Cited

U.S. PATENT DOCUMENTS 5,485,249 A 1/1996 Higeta et al.
5,740,499 A 4/1998 Higeta et al.
5,809,374 A 9/1998 Tsuda et al.
(Continued)

FOREIGN PATENT DOCUMENTS

CN 101750941 6/2010
CN 101981519 2/2011
(Continued)

OTHER PUBLICATIONS

Communication in European Patent Application No. 12 795 093.9, dated Dec. 13, 2017.
(Continued)

*Primary Examiner* — David M. Gray
*Assistant Examiner* — Geoffrey T Evans
(74) *Attorney, Agent, or Firm* — Venable LLP

(57) ABSTRACT

A cartridge detachably mountable to a main assembly of an image forming apparatus includes a cartridge frame formed of a resin material; a plurality of resin members molded on the cartridge frame by injection molding of a resin material different from that of the cartridge frame; a plurality of contact surfaces, provided on the cartridge frame, to which metal molds corresponding to the resin members are to be contacted from the same side when the resin members are molded; and a plurality of resin material inlet ports, provided in an opposite side of said cartridge frame from a side where the contact surfaces are provided. The resin material has been flowed into the cartridge frame when the resin members are molded.

14 Claims, 13 Drawing Sheets

(56) References Cited

U.S. PATENT DOCUMENTS

| | | | |
|---|---|---|---|
| 5,884,124 | A | 3/1999 | Karakama et al. |
| 5,966,567 | A | 10/1999 | Matsuzaki et al. |
| 6,078,763 | A | 6/2000 | Hoshi |
| 6,129,504 | A | 10/2000 | Gammerler et al. |
| 6,144,815 | A | 11/2000 | Chadani et al. |
| 6,154,623 | A | 11/2000 | Suzuki et al. |
| 6,173,140 | B1 | 1/2001 | Suzuki et al. |
| 6,173,145 | B1 | 1/2001 | Chadani et al. |
| 6,205,305 | B1 | 3/2001 | Suzuki et al. |
| 6,246,853 | B1 | 6/2001 | Suzuki et al. |
| 6,282,389 | B1 | 8/2001 | Matsuzaki et al. |
| 6,415,121 | B1 | 7/2002 | Suzuki et al. |
| 6,442,359 | B1 | 8/2002 | Numagami et al. |
| 6,463,233 | B2 | 10/2002 | Kojima et al. |
| 6,549,736 | B2 | 4/2003 | Miyabe et al. |
| 6,577,831 | B1 | 6/2003 | Kojima et al. |
| 6,654,578 | B2 | 11/2003 | Suzuki et al. |
| 6,771,920 | B2 | 8/2004 | Abe et al. |
| 6,795,666 | B2 | 9/2004 | Miyabe et al. |
| 6,823,153 | B2 | 11/2004 | Ueno et al. |
| 6,865,357 | B2 | 3/2005 | Fujita et al. |
| 6,868,243 | B2 | 3/2005 | Watanabe et al. |
| 6,873,815 | B2 | 3/2005 | Matsuda et al. |
| 6,931,226 | B2 | 8/2005 | Chadani et al. |
| 6,934,485 | B2 | 8/2005 | Miyabe et al. |
| 6,990,302 | B2 | 1/2006 | Toba et al. |
| 7,027,756 | B2 | 4/2006 | Hoshi et al. |
| 7,072,594 | B2 | 7/2006 | Hoshi et al. |
| 7,099,607 | B2 | 8/2006 | Suzuki et al. |
| 7,127,194 | B2 | 10/2006 | Hoshi et al. |
| 7,162,174 | B2 | 1/2007 | Suzuki et al. |
| 7,162,181 | B2 | 1/2007 | Maeshima et al. |
| 7,346,293 | B2 | 3/2008 | Suzuki et al. |
| 7,349,649 | B2 | 3/2008 | Hoshi et al. |
| 7,366,439 | B2 | 4/2008 | Anan et al. |
| 7,912,404 | B2 | 3/2011 | Hoshi et al. |
| 7,933,534 | B2 | 4/2011 | Hoshi et al. |
| 8,155,553 | B2 | 4/2012 | Takarada |
| 8,249,485 | B2 | 8/2012 | Horikawa et al. |
| 8,682,211 | B2 | 3/2014 | Hoshi et al. |
| 9,002,233 | B2 | 4/2015 | Yamasaki et al. |
| 9,104,139 | B2 | 8/2015 | Hoshi et al. |
| 9,128,417 | B2 | 9/2015 | Yamasaki et al. |
| 9,500,979 | B2 | 11/2016 | Takarada |
| 9,529,306 | B2 | 12/2016 | Hoshi et al. |
| 2004/0131380 | A1 | 7/2004 | Kuma et al. |
| 2009/0245851 | A1 | 10/2009 | Hoshi et al. |
| 2009/0290904 | A1 | 11/2009 | Kawai et al. |
| 2010/0150604 | A1 | 6/2010 | Hayashida et al. |
| 2010/0150615 | A1 | 6/2010 | Nakagawa et al. |
| 2011/0170903 | A1 | 7/2011 | Hoshi et al. |
| 2011/0286764 | A1 | 11/2011 | Nomura et al. |
| 2013/0022368 | A1 | 1/2013 | Takarada et al. |
| 2013/0114972 | A1 | 5/2013 | Takarada et al. |
| 2013/0121720 | A1 | 5/2013 | Hoshi et al. |
| 2013/0129375 | A1 | 5/2013 | Yamasaki et al. |
| 2013/0170851 | A1 | 7/2013 | Takarada et al. |
| 2014/0086629 | A1 | 3/2014 | Fujiwara et al. |
| 2014/0093271 | A1 | 4/2014 | Hoshi |
| 2016/0246251 | A1 | 8/2016 | Satomura |

FOREIGN PATENT DOCUMENTS

| | | |
|---|---|---|
| EP | 1 055 505 A2 | 11/2000 |
| EP | 2 607 966 A1 | 6/2013 |
| JP | 3231848 | 7/1994 |
| JP | H07-121085 | 5/1995 |
| JP | 11272071 | 10/1999 |
| JP | 2007047491 | 2/2007 |
| JP | 2008-292556 | 12/2008 |
| JP | 2010-160481 | 7/2010 |
| JP | 2013-122489 | 6/2013 |

OTHER PUBLICATIONS

Office Action in Chinese Patent Application No. 201280054366.6, dated Mar. 25, 2016 (with English translation).

Office Action in Japanese Patent Application No. 2011-270107, dated Mar. 8, 2016.

Feb. 7, 2017 Office Action in Japanese Patent Application No. 2016-114703.

May 9, 2017 Office Action in Japanese Patent Application No. 2016-114703.

Written Opinion of the International Searching Authority in International Application No. PCT/2012/079578, dated Jan. 30, 2013.

Nov. 22, 2016 Office Action in Vietnamese Patent Application No. 1-2014-01663 (with English translation).

Office Action in Japanese Patent Application No. 2011-270107, dated Aug. 18, 2015.

Communication in European Patent Application No. 12 795 096.9, dated Dec. 13, 2017.

Oct. 15, 2018 Office Action in Chinese Patent Application No. 201280054366.6 (with English translation).

Nov. 21, 2018 Office Action in European Patent Application No. 12 795 093.9.

Mar. 30, 2018 Office Action in Chinese Patent Application No. 201280054366.6 (with English translation).

CARTRIDGE AND UNIT

FIELD OF THE INVENTION AND RELATED ART

The present invention relates to a cartridge detachably mountable to an electrophotographic image forming apparatus main assembly and a unit for use with the electrophotographic image forming apparatus main assembly.

In a conventional electrophotographic image forming apparatus using an electrophotographic image forming process, an electrophotographic photosensitive member and a process member acting on the electrophotographic photosensitive member are integrally assembled into a unit to prepare a process cartridge. Further, a type in which the process cartridge is detachably mountable to the image forming apparatus main assembly is employed.

In such a process cartridge, in order to prevent a developer (toner) accommodated in the process cartridge from leaking out to an outside, the process cartridge is configured to seal between cartridge frames and between parts, for constituting the process cartridge, with a plurality of seal members.

Here, as the seal member, an elastic member such as urethane foam, soft rubber or elastomer resin is used. The seal member is bonded to a bonding portion between the frames or between the parts with high accuracy (Japanese Laid-Open Patent Application (JP-A) Hei 11-272071).

Further, in the case where the flexible sheet is used as the seal member, in order to fix the flexible sheet to the cartridge frame, the parts and the like constituting the process cartridge, a fixing member such as a double-side tape is applied onto the cartridge frame or the like (Japanese Patent No. 3231848).

Further, the process cartridge is provided with an electrode member for electrically connecting a member undergoing electric conduction, such as the electrophotographic photosensitive member or the process member acting on the electrophotographic photosensitive member, with the electrophotographic image forming apparatus. As the electrode member, there are an electrode member prepared by bending a thin metal plate, an electrode member molded with an electroconductive resin material, and the like. A constitution for assembling the electrode member with the cartridge frame or the like is employed (JP-A 2007-47491).

In recent years, in order to realize cost reduction by an increase in manufacturing efficiency and to realize stability of a quality during assembling, manufacturing of the process cartridge has been made, in place of a manual assembling operation, by an automatic machine using a device in each of assembling steps. Also with respect to the seal member, the fixing member and the electrode member, assembling by the automatic machine has been effected.

However, the above-described conventional constitutions were accompanied with the following problems. That is, the seal member is a soft part and therefore it is difficult to hold the seal member by the automatic machine (robot), so that it is difficult to apply the seal member onto the cartridge frame with high accuracy. Further, the fixing member such as the double-side tape is similarly a soft strip part and therefore it is difficult to apply the fixing member onto the cartridge frame with high accuracy by the automatic machine. Further, as the electrode member, the metal plate bent in a complicated manner is used in many cases, so that there is a possibility of entanglement of the parts during supply and it is difficult to assemble the electrode member with the cartridge frame by the automatic machine. In addition, the above-described members are assembled in respective assembling steps and therefore there is a need to provide assembling steps in number corresponding to the number of the parts.

SUMMARY OF THE INVENTION

The present invention has been accomplished in view of the above-described circumstances. A principal object of the present invention is to provide a cartridge and a unit which are capable of improving an assembling property when a constituent member is assembled with a cartridge frame by an automatic machine and which are also capable of realizing the assembling with high accuracy.

According to an aspect of the present invention, there is provided a cartridge detachably mountable to a main assembly of an image forming apparatus, comprising: a cartridge frame formed of a resin material; a plurality of resin members molded on the cartridge frame by injection molding of a resin material different from that of the cartridge frame; a plurality of contact surfaces, provided on the cartridge frame, to which metal molds corresponding to the resin members are to be contacted from the same side when the resin members are molded; and a plurality of resin material inlet ports, provided in an opposite side of the cartridge frame from a side where the contact surfaces are provided, wherein the resin material has been flowed into the cartridge frame when the resin members are molded.

According to another aspect of the present invention, there is provided a cartridge detachably mountable to a main assembly of an image forming apparatus, comprising: a cartridge frame formed of a resin material; a plurality of resin members molded on the cartridge frame by injection molding of a resin material different from that of the cartridge frame; a plurality of contact surfaces, provided on the cartridge frame, to which metal molds corresponding to the resin members are to be contacted from the same side when the resin members are molded; and a plurality of resin material inlet ports, wherein the resin material has been flowed into the cartridge frame when the resin members are molded, and wherein the resin material inlet ports are provided so that their positions with respect to a longitudinal direction of the cartridge frame do not overlap with each other when the resin material inlet ports are viewed from a direction parallel to the contact surfaces.

According to another aspect of the present invention, there is provided a unit for use with an electrophotographic image forming apparatus, comprising: a cartridge frame formed of a resin material; a cleaning member, mounted on the cartridge frame, for removing a developer from an electrophotographic photosensitive member; a sheet member contactable to the electrophotographic photosensitive member; a plurality of resin members molded on the cartridge frame by injection molding of a resin material different from that of the cartridge frame; an accommodating portion for accommodating the developer, wherein the accommodating portion is constituted by the cartridge frame, the cleaning member, the sheet member and the recording material members; a plurality of contact surfaces, provided on the cartridge frame, to which metal molds corresponding to the resin members are to be contacted from the same side when the resin members are molded; and a plurality of resin material inlet ports, provided in an opposite side of the cartridge frame from a side where the contact surfaces are provided, wherein the resin material has been flowed into the cartridge frame when the resin members are molded.

According to a further aspect of the present invention, there is provided a unit for use with an electrophotographic image forming apparatus, comprising: a cartridge frame formed of a resin material; a cleaning member, mounted on the cartridge frame, for removing a developer from an electrophotographic photosensitive member; a sheet member contactable to the electrophotographic photosensitive member; a plurality of resin members molded on the cartridge frame by injection molding of a resin material different from that of the cartridge frame; an accommodating portion for accommodating the developer, wherein the accommodating portion is constituted by the cartridge frame, the cleaning member, the sheet member and the recording material members; a plurality of contact surfaces, provided on the cartridge frame, to which metal molds corresponding to the resin members are to be contacted from the same side when the resin members are molded; and a plurality of resin material inlet ports, wherein the resin material has been flowed into the cartridge frame when the resin members are molded, and wherein the resin material inlet ports are provided so that their positions with respect to a longitudinal direction of the cartridge frame do not overlap with each other when the resin material inlet ports are viewed from a from a direction parallel to the contact surfaces.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments for carrying out the present invention will be exemplarily and specifically described with reference to the drawings. However, dimensions, materials, shapes, relative arrangements and the like of constituent elements described in the following embodiments are appropriately changed depending on constitutions or various conditions of devices (apparatuses) to which the present invention is applied and thus the scope of the present invention is not limited thereto.

The present invention relates to a cartridge detachably mountable to a main assembly of an electrophotographic image forming apparatus. Here, the electrophotographic image forming apparatus forms an image on a recording material by using an image forming process of an electrophotographic type. Examples of the electrophotographic image forming apparatus may include an electrophotographic copying machine, an electrophotographic printer (such as a laser beam printer or an LED printer), a facsimile machine and a word processor. Further, the cartridge is a generic name for a drum cartridge for supporting an electrophotographic photosensitive drum (electrophotographic photosensitive member), a developing cartridge for supporting a developing means, a process cartridge prepared by assembling the electrophotographic photosensitive drum and a process member into a cartridge (unit), and the like cartridge. The process member acts on the electrophotographic photosensitive drum and examples thereof may include a charging means, the developing means, a cleaning means and the like, which act on the electrophotographic photosensitive drum.

Embodiment 1

An image forming apparatus and a process cartridge in this embodiment will be specifically described below with reference to the drawings. In the following description, a longitudinal direction is a direction (rotational axis direction of a photosensitive drum) crossing (substantially perpendicular to) a direction in which the process cartridge is mounted into an image forming apparatus main assembly.

General Structure)

Figure 1:
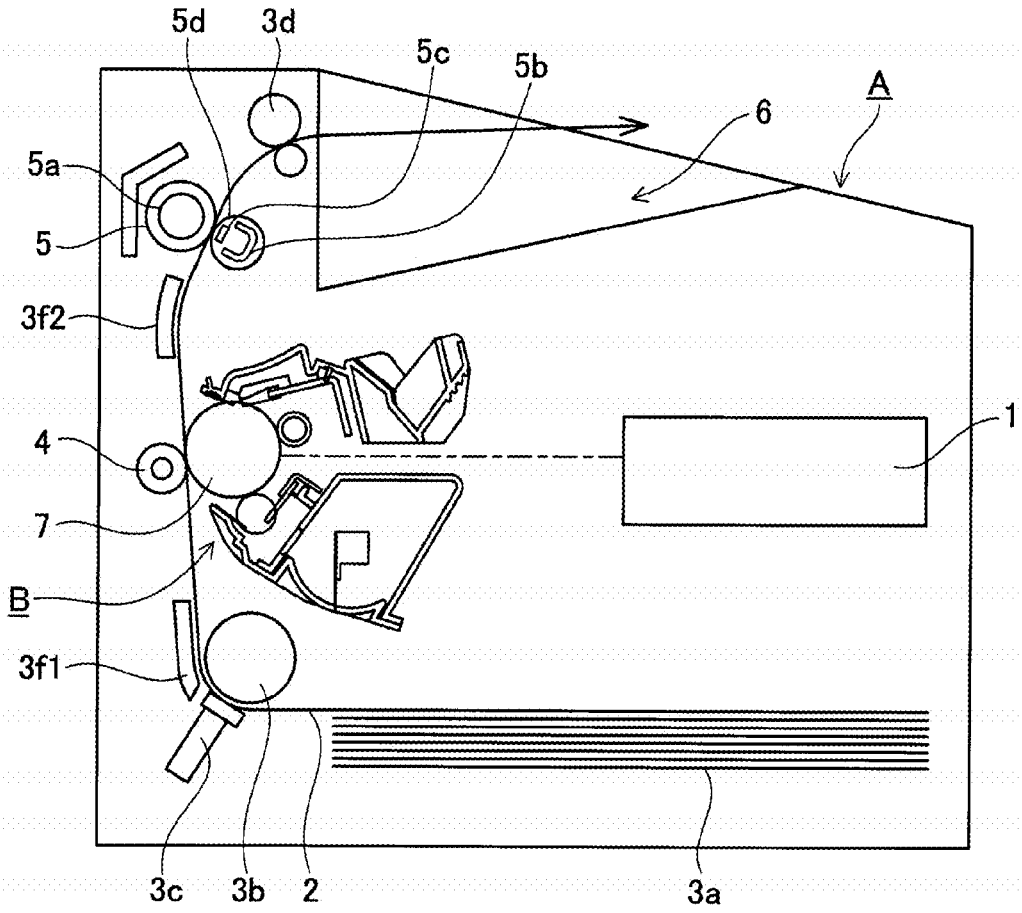
FIG. 1 is a schematic sectional view showing a general structure of an image forming apparatus in Embodiment 1.
Figure 2:
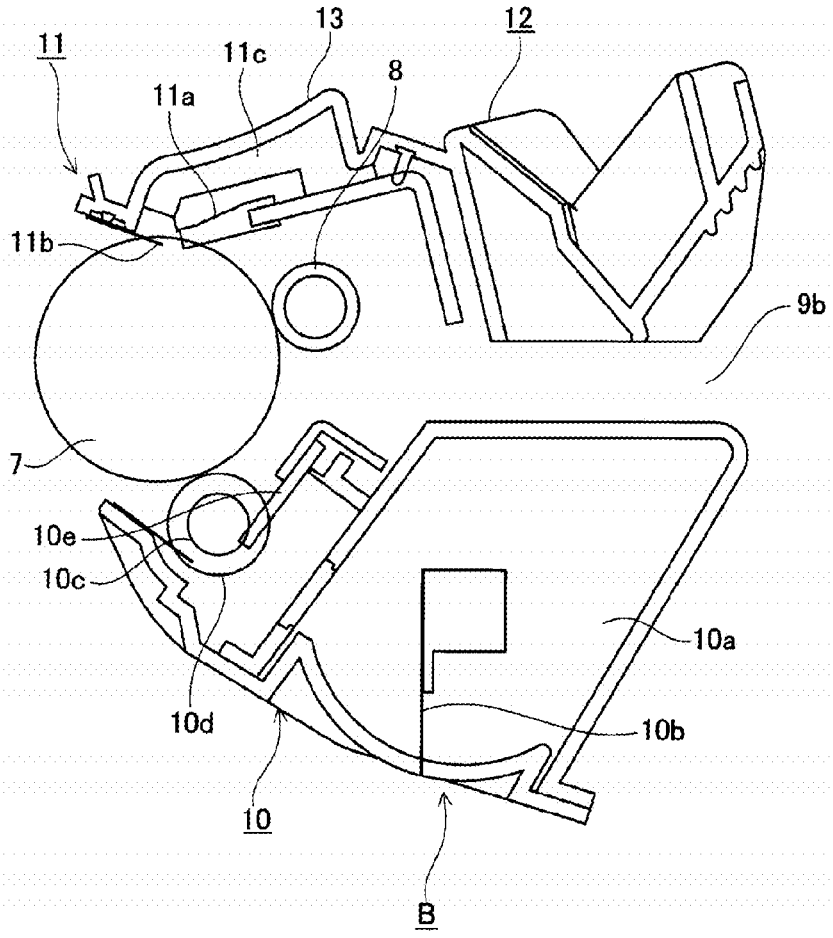
FIG. 2 is a schematic sectional view of a process cartridge in Embodiment 1.

A general structure of each of the image forming apparatus and the process cartridge will be described with reference to FIGS. 1 and 2. FIG. 1 is a schematic sectional view showing a general structure of a laser beam printer as an example of the image forming apparatus in this embodiment, and FIG. 2 is a schematic sectional view of the process cartridge in this embodiment.

The general structure of an image forming apparatus main assembly A will be described. First, a drum-shaped electrophotographic photosensitive member (image bearing member, hereinafter referred to as a photosensitive drum) 7 is irradiated with information light, on the basis of image information, emitted from an optical system as an optical means. As a result, an electrostatic latent image is formed on the photosensitive drum 7 and then is developed with a developer (hereinafter referred to as a toner), so that a toner image is formed on a surface of the photosensitive drum 7. In synchronism with the toner image formation, sheets of a recording material (recording medium such as recording paper, OHP sheet or cloth) 2 are separated and fed one by one from a feeding portion (cassette) 3*a* by a pick-up roller 3*b* and a press-contact member 3*c* press-contacted to the pick-up roller 3*b*. Then, by applying a voltage to a transfer roller 4 as a transfer means, the toner image formed on the photosensitive drum 7 of a process cartridge B is transferred onto the recording material 2 fed along a feeding guide 3*f*1.

Then, the recording material 2 on which the toner image is transferred is conveyed to a fixing means 5 along a conveying guide 3*f*2. The fixing means 5 includes a driving roller 5*a* and a rotatable fixing member 5*d* which incorporates therein a heater 5*b* and which is constituted by a cylindrical sheet rotatably supported by a supporting member 5*c*, and fixes the toner image on the passing recording material 2 under application of heat and pressure. The recording material 2 on which the toner image is fixed in conveyed by a discharging roller 3*d* and then is discharged on a discharge portion 6 via a reverse conveyance path. In this embodiment, a conveying (feeding) means 3 is constituted by the pick-up roller 36, the press-contact member 3*c*, the discharging roller 3*d* and the like but is not limited thereto.

(Structure of Process Cartridge)

The process cartridge B includes, as shown in FIG. 2, the photosensitive drum 7 and at least one process member. Examples of the process member may include a charging member for electrically charging the photosensitive drum 7, a developing member for developing the electrostatic latent image formed on the photosensitive drum 7, and a cleaning member for removing the toner (residual toner, waste toner) remaining on the photosensitive drum 7 (electrophotographic photosensitive member surface).

In the process cartridge B in this embodiment, as shown in FIG. 2, the photosensitive drum 7 having a photosensitive layer is rotationally driven and its surface is uniformly charged by voltage application to a charging roller 8 as the charging member. The process cartridge B is constituted so that the photosensitive drum 7 in a charged state is exposed, via an exposure opening 9*b*, to the information light (light image), on the basis of the image information, emitted from the optical system 1 thereby to form the electrostatic latent image on the surface of the photosensitive drum 7 and then the electrostatic latent image is developed by the developing member.

A developing operation by the developing member will be described. First, the toner in a toner accommodating portion (developer accommodating portion) 10*a* is fed toward a developing roller 10*d*, in which a fixed magnet 10*c* is incorporated, as a rotatable developing member (developer carrying member) by a rotatable feeding member 10*b* as a toner feeding means. Then, by rotating the developing roller 10*d*, an amount of the developer on the surface of the developing roller 10*d* is regulated by a developing blade 10*e* as a regulating member (process means), so that a toner layer to which triboelectric charges are imparted is formed on the surface of the developing roller 10*d*. Then, the toner is transferred from the surface of the developing roller 10*d* onto the photosensitive drum 7 depending on the electrostatic latent image, so that the toner image is formed on the photosensitive drum 7 and thus the electrostatic latent image is visualized.

Then, by applying to the transfer roller 4 a voltage of an opposite polarity to a charge polarity of the toner image, the toner image is transferred from the photosensitive drum 7 onto the recording material 2. The toner remaining on the photosensitive drum 7 after the transfer is removed from the surface of the photosensitive drum 7 by a cleaning blade 11*a* as the cleaning member and is accommodated in a residual toner accommodating portion (developer accommodating portion) 11*c*. A receptor sheet 11*b* as a thin plate member (sheet member) is provided to contact the photosensitive drum 7, so that the toner accommodated in the residual toner accommodating portion 11*c* is prevented from leaking out of the residual toner accommodating portion 11*c*.

The process cartridge B is constituted by a photosensitive drum unit 11 and a developing unit 10. The photosensitive drum unit 11 includes the photosensitive drum 7, the charging roller 8, the cleaning blade 11*a*, the receptor sheet 11*b* and a cleaning frame unit 12. The developing unit 10 includes the developing member.

(Structure of Cleaning Frame Unit)

Figure 3:
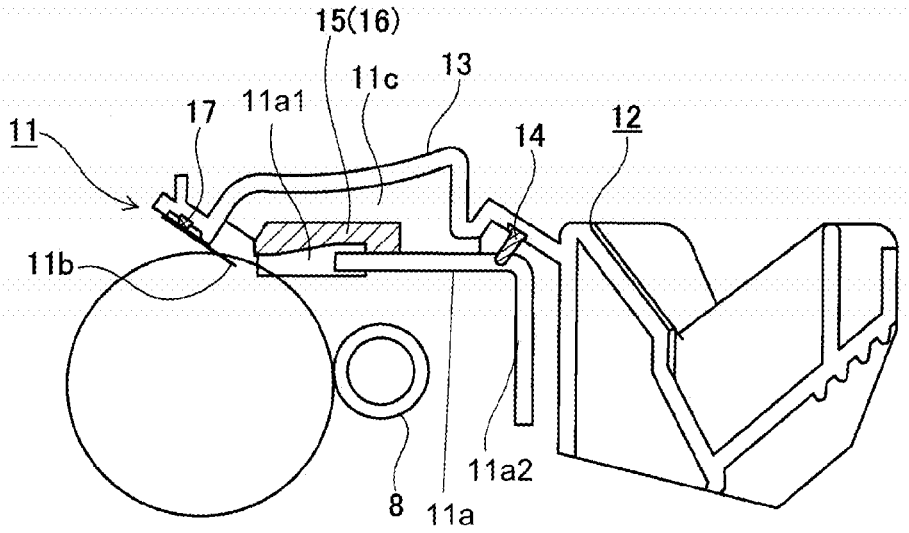
FIG. 3 is a schematic sectional view of a photosensitive drum unit in Embodiment 1.
Figure 4:
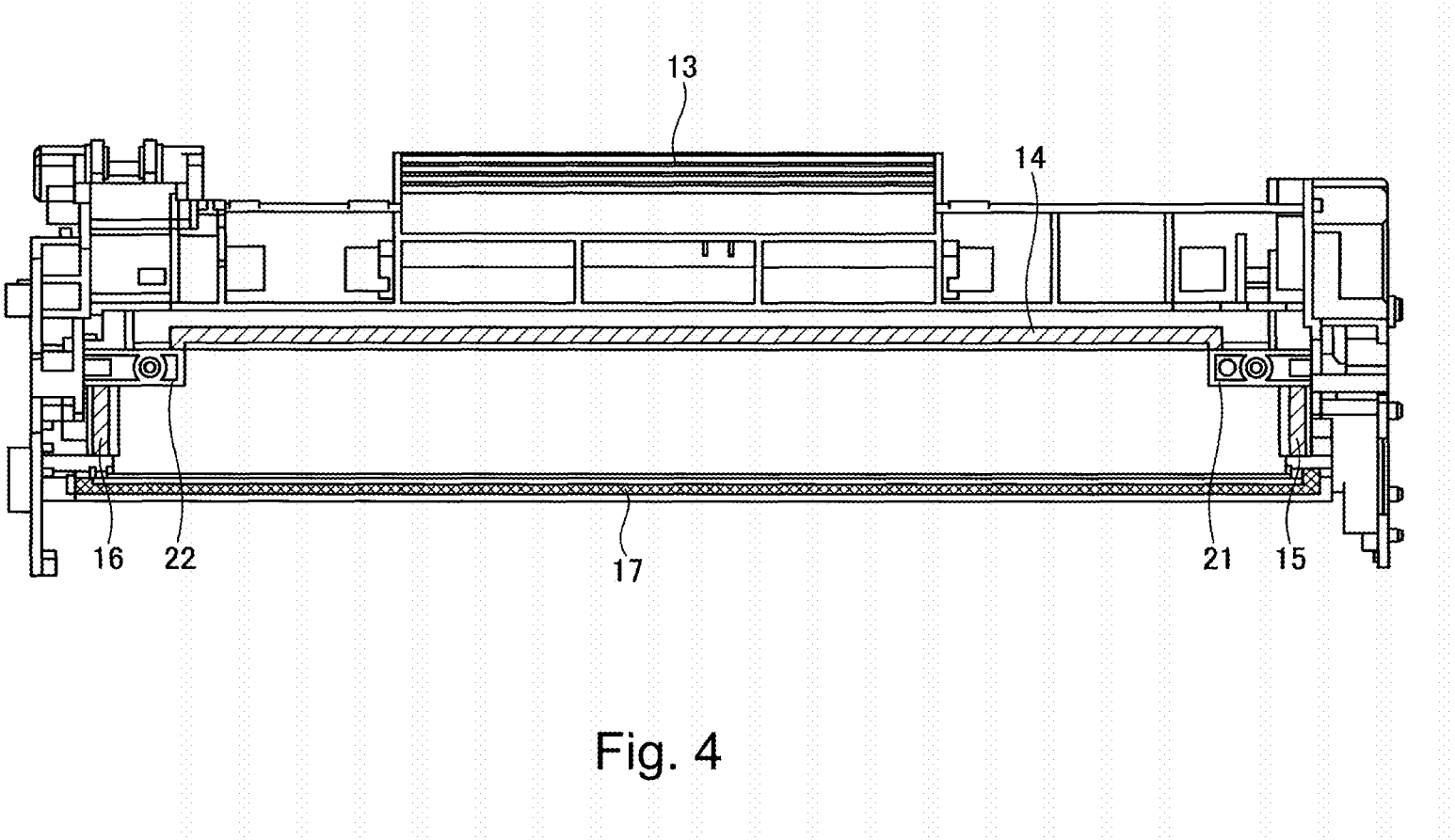
FIG. 4 is a schematic front view of a cleaning frame unit in Embodiment 1.
Figure 5:
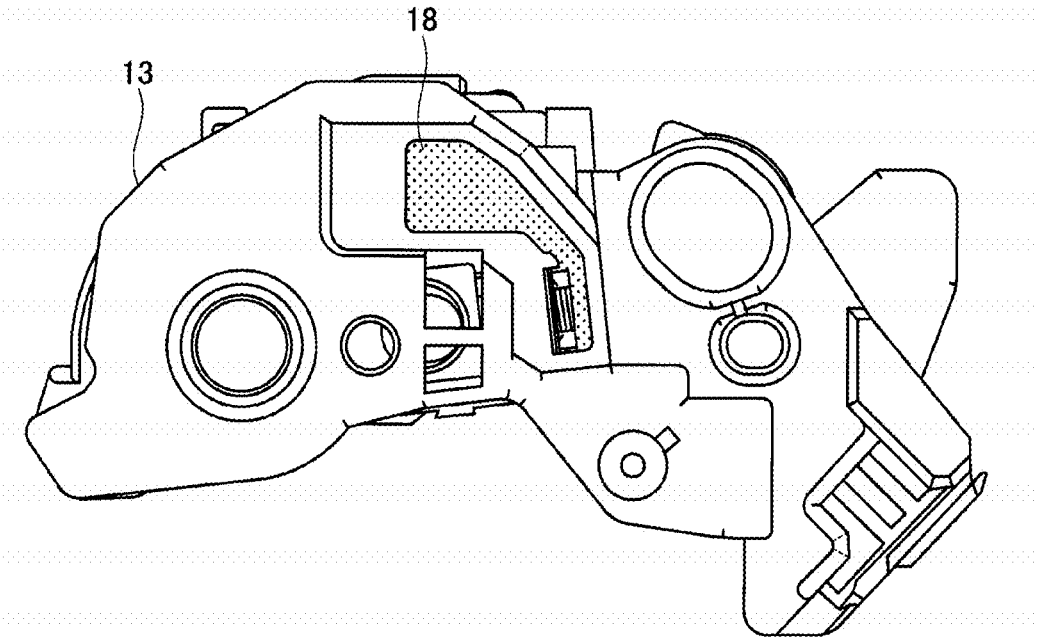
FIG. 5 is a schematic side view of the cleaning frame unit in Embodiment 1.
Figure 6:
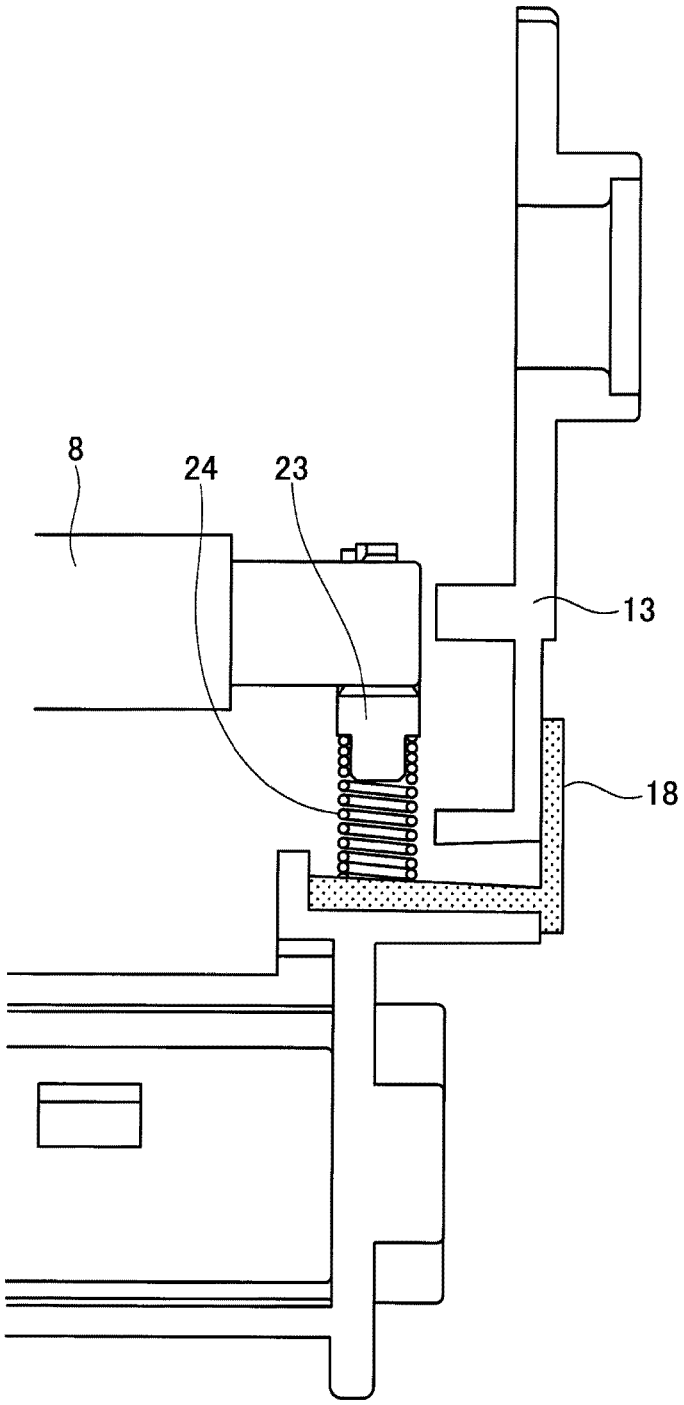
FIG. 6 is a schematic sectional view of an electrode member molded on the cleaning frame unit in Embodiment 1.

A structure of the cleaning frame unit in this embodiment will be specifically described with reference to FIGS. 3 to 6. FIG. 3 is a schematic sectional view of the photosensitive drum unit in this embodiment, and FIG. 4 is a schematic front view of the cleaning frame unit in this embodiment. FIG. 5 is a schematic side view of the cleaning frame unit in this embodiment, and FIG. 6 is a schematic sectional view of the electrode member molded on the cleaning frame unit in this embodiment.

As shown in FIGS. 3 and 4, the cleaning frame unit 12 includes a cleaning container 3 including the residual toner accommodating portion 11*c* and includes the cleaning blade 11*a*, an under-blade seal 14 and vertical seals 15 and 16. The under-blade seal 14 and the vertical seals 15 and 16 are used, as a seal member for preventing leakage of the residual toner, for sealing a gap between the cleaning blade 11*a* and the cleaning container 13. Particularly, the under-blade seal 14 as a first seal member contacts a supporting portion 11*a*2, constituted by a metal plate, for supporting a blade portion 11*a*1 of the cleaning blade 11*a*. Further, the under-blade seal 14 is a seal member for sealing the gap between the cleaning blade 11*a* and the cleaning container 13 over a longitudinal direction of the cleaning container 13. The vertical seals 15 and 16 as a second seal member contact both of the blade portion 11*a*1 and the supporting portion 11*a*2 and are seal members for sealing, at longitudinal end portions of the cleaning container 13, the gap between the cleaning blade 11*a* and the cleaning container 13 along a widthwise direction of the cleaning container 13.

The cleaning container 13 is provided with a fixing member 17 for fixing the receptor sheet 11*b* on the cleaning container 13. Further, as shown in FIG. 5, also an electrode member (electric energy supplying member, electric contact member) 18 for supplying electric energy to the charging roller 8 is provided on the cleaning container 13. The cleaning container 13 corresponds to a cartridge frame formed of a resin material.

The under-blade seal 14 is provided and extended between blade mounting bearing surfaces 21 and 22 provided at longitudinal end portions of the cleaning container 13. The under-blade seal 14 has a shape such that it extends at a predetermined angle (obliquely) from the vertical direction with respect to the cleaning blade 11*a*, and is formed in an oblique direction also with respect to a mold drawing direction of the cleaning container 13. Further, in order to stabilize a contact state with the cleaning blade 11*a*, an obliquely extended end of the under-blade seal 14 has a curvature shape. The vertical seals 15 and 16 are provided in the neighborhood of the blade mounting bearing surfaces 21 and 22 at the longitudinal end portion of the cleaning container 13. The under-blade seal 14 and the vertical seals 15 and 16 are integrally injection-molded on the cleaning container 13 (cartridge frame) by using an elastic seal material.

In this embodiment, as the elastic seal material, elastomer resin is used. As the elastomer resin, styrene-based elastomer resin which is different from the resin material for the cleaning container 13 but is a similar type material and has elasticity may preferably be used since it is excellent in a disassembling operation property during recycling of the process cartridge B. That is, when the same material parts are not required to be disassembled.

However, another elastomer resin may also be used so long as it has a similar mechanical characteristic and it is also possible to use a silicone-based rubber or a soft rubber. In this embodiment, the above-described various elastomer resins, rubbers and the like as the elastic seal material are inclusively referred to as "elastomer resin".

In this embodiment, also the fixing member 17 is integrally injection-molded on the cleaning container 13. The fixing member 17 is fixed with the receptor sheet 11*b* by welding. In this embodiment, as a material for the fixing member 17, the elastomer resin is used. The elastomer resin used for the fixing member 17 is different from the elastomer resin used for the cleaning container 13 and the seal material and is suitable for being fixed with the receptor sheet 11*b* by welding. The fixing member 17 has a shape such that it extends in the same oblique direction as that of the under-blade seal 14. The fixing member 17 is described as being used for fixing the receptor sheet 11*b* on the cleaning container 13. However, the fixing member 17 also functions as a seal member for preventing the developer from leaking out from a gap between the receptor sheet 11*b* and the cleaning container 13.

The electrode member 18 is, as shown in FIG. 5, provided on a side surface of the cleaning container 13 in one longitudinal end side. Further, as shown in FIG. 6, the electrode member 18 contacts an electroconductive compression spring 24, mounted on an electroconductive charging roller terminal 23 for shaft-supporting the charging roller 8, in order to enable electrical connection. Also the electrode member 18 is integrally molded on the cleaning container 13. As a material for the electrode member 18, electroconductive resin is used.

(Molding Step on Cleaning Container)

A molding step for molding the under-blade seal 14, the vertical seals 15 and 16, the fixing member 17 and the electrode member 18 on the cleaning container 13 in the same process will be described with reference to FIGS. 7 to 12.

Figure 7:
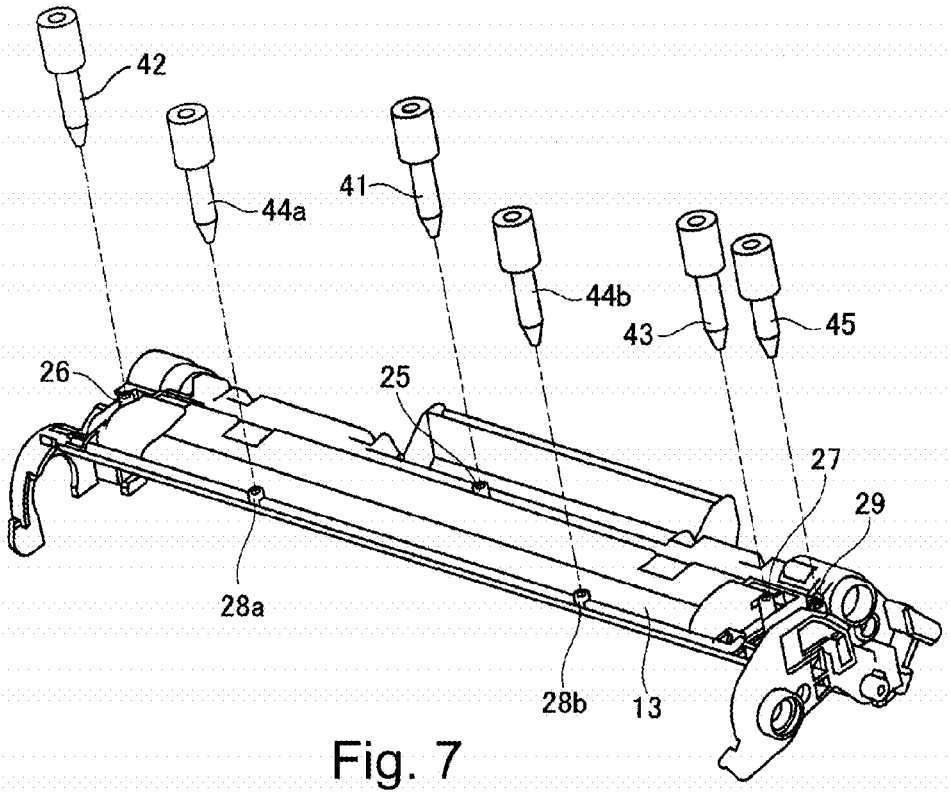
FIG. 7 is a schematic perspective view showing injection ports of a cleaning container in Embodiment 1.
Figure 8:
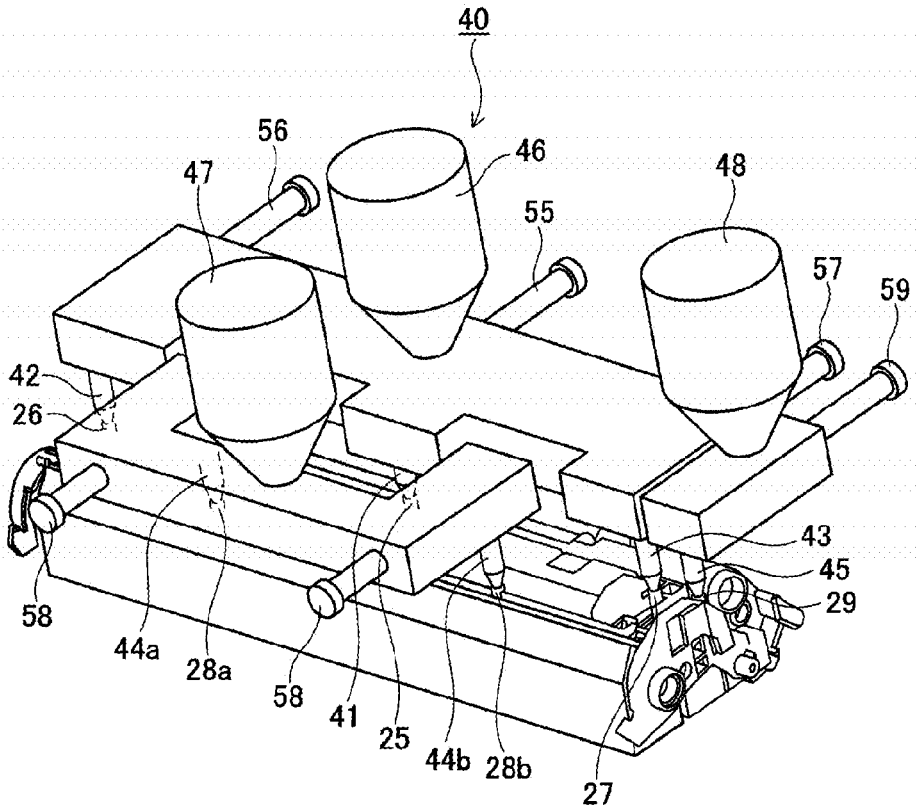
FIG. 8 is a perspective view showing a state in which the cleaning container in Embodiment 1 is set in a resin material injection device.
Figure 9:
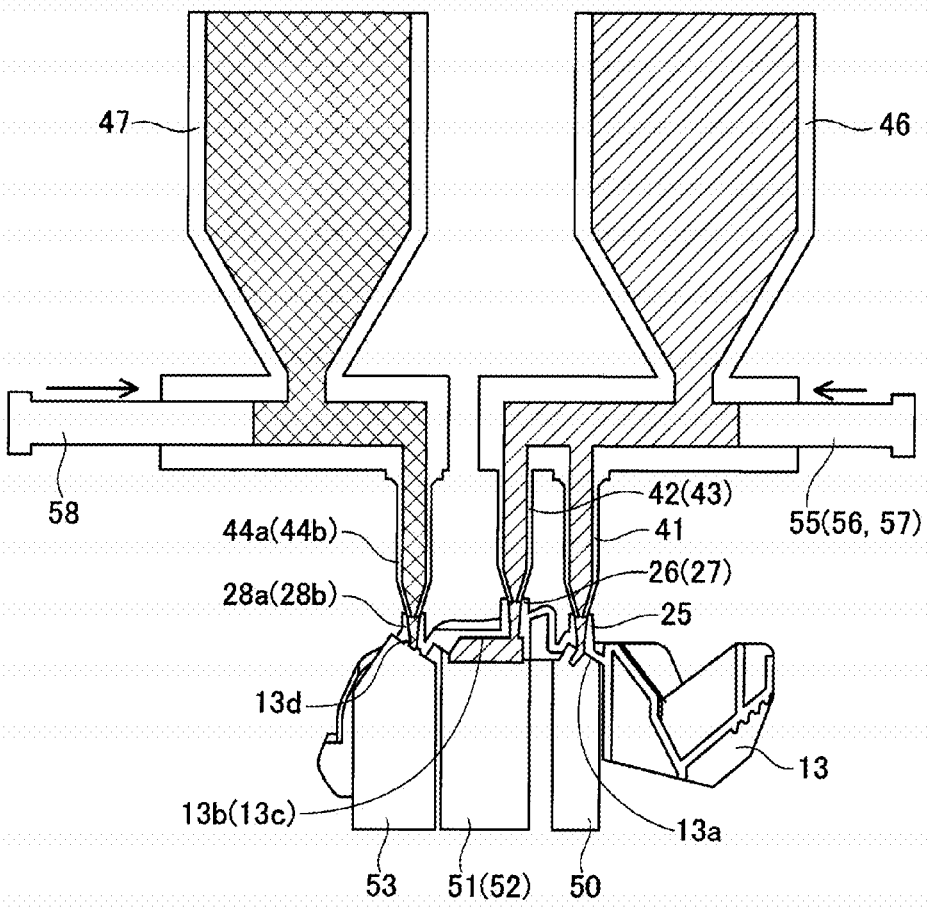
FIG. 9 is a schematic sectional view showing a state in which resin materials are injected for molding into the cleaning container in Embodiment 1.
Figure 10:
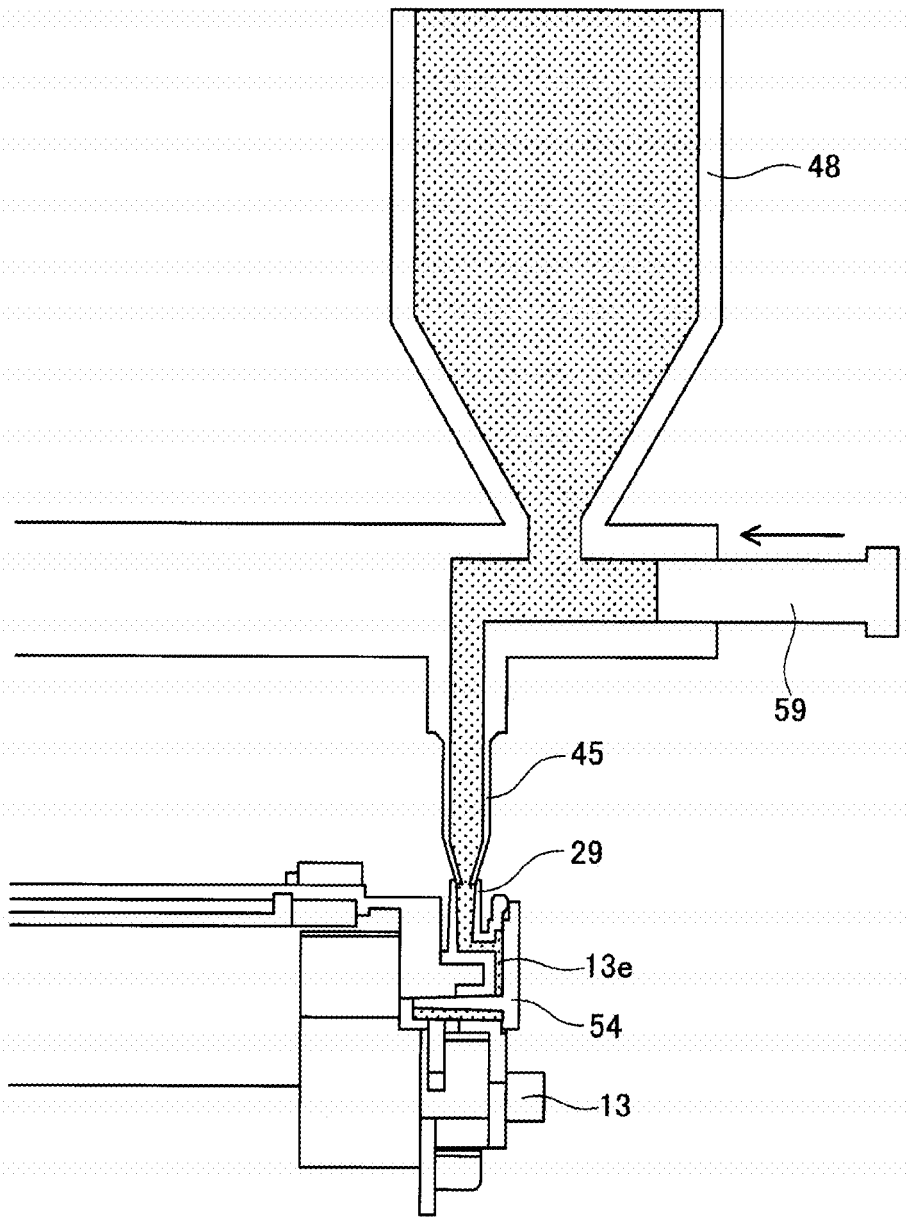
FIG. 10 is a schematic sectional view showing a state in which injection molding of the resin material is effected in a longitudinal end side of the cleaning member.
Figure 11:
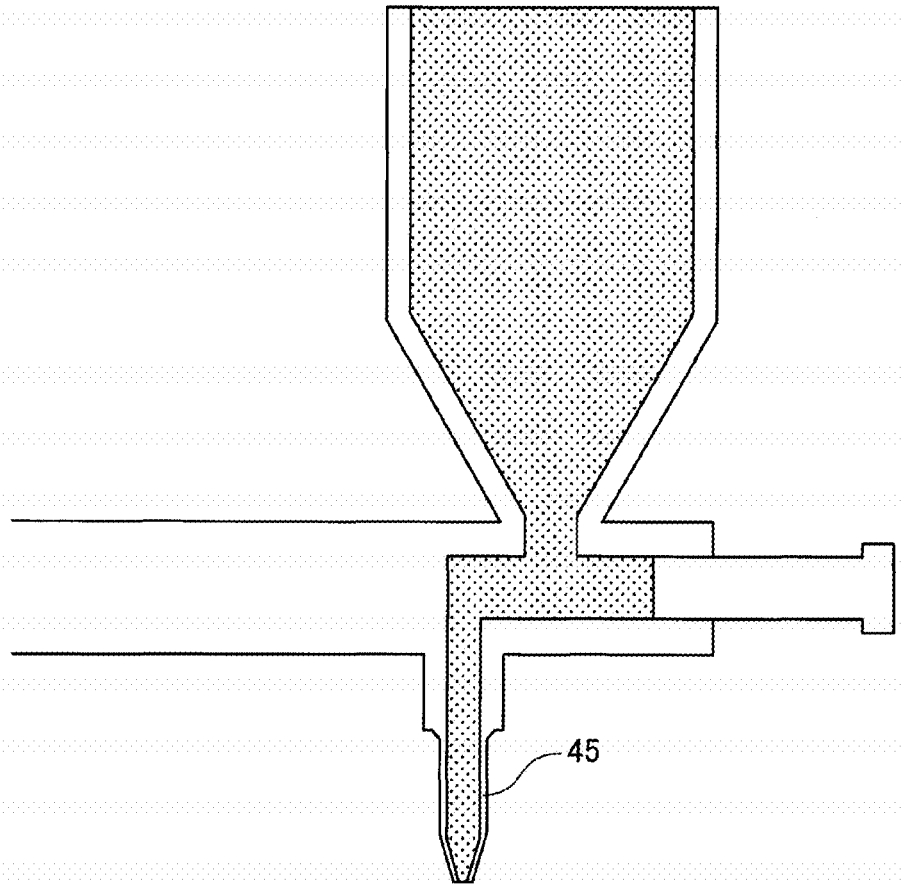
FIG. 11 is a schematic sectional view showing a state after the injection molding of the resin material is effected in the longitudinal end side of the cleaning member.
Figure 11:
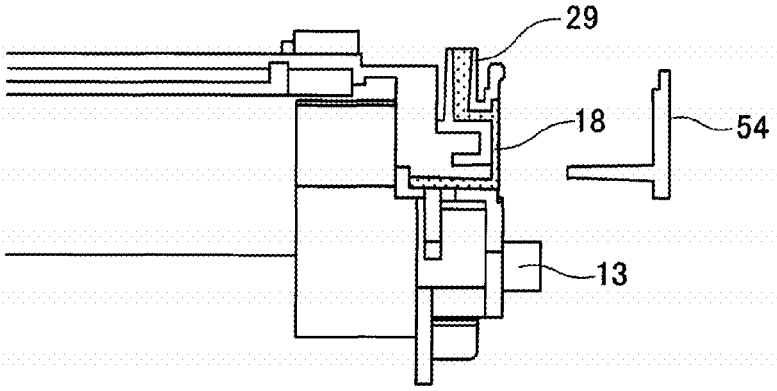
Figure 12:
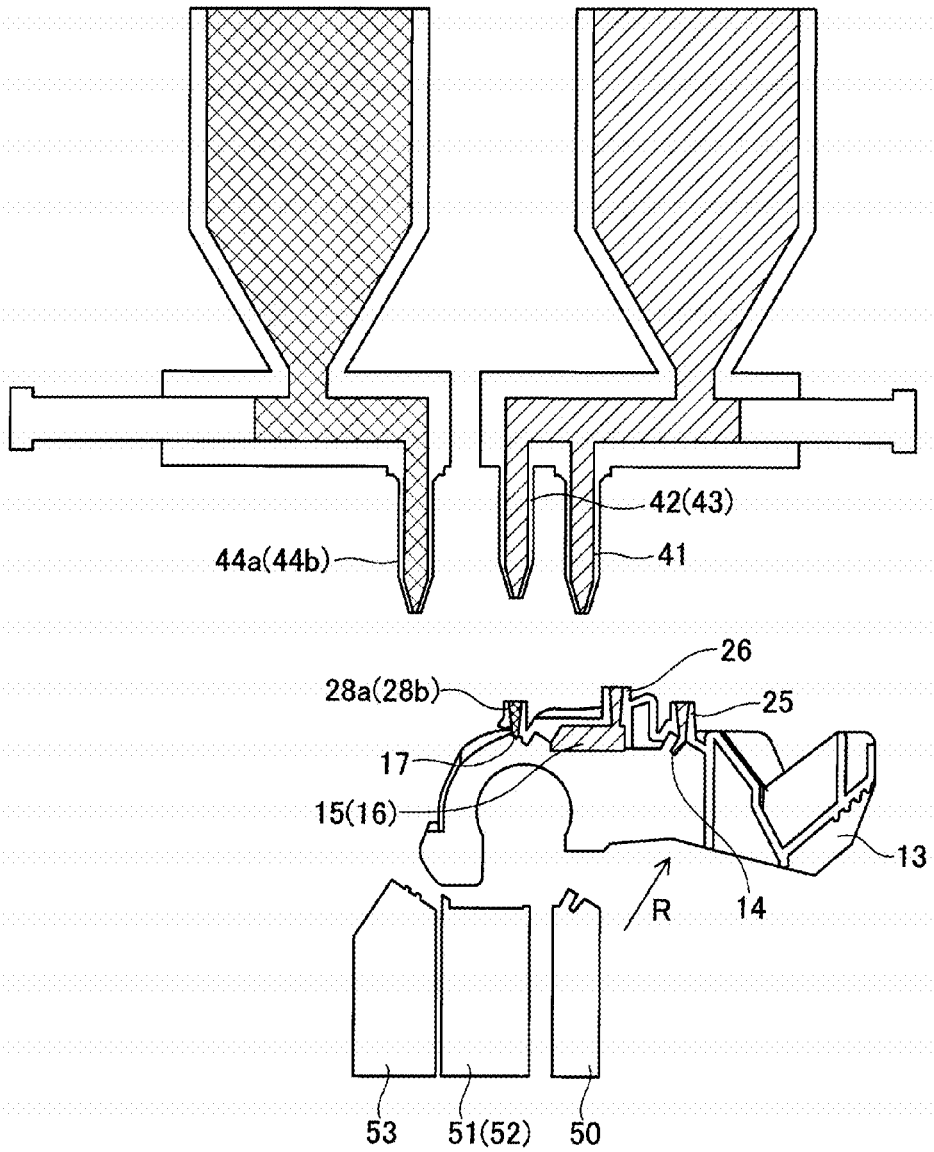
FIG. 12 is a schematic sectional view showing a state after resin materials are injected for molding into the cleaning member.

FIG. 7 is a schematic perspective view showing an injection port (injection portion) of the cleaning container in this embodiment, FIG. 8 is a schematic perspective view showing a state in which the cleaning container in this embodiment is set in a resin material injection device, and FIG. 9 is a schematic sectional view showing a state in which injection molding of the resin material on the cleaning container in this embodiment is made. FIG. 10 is a schematic sectional view showing a state in which injection molding of the resin material is made in one longitudinal end side of the cleaning container in this embodiment, and FIG. 11 is a schematic sectional view showing a state after the injection molding of the resin material is made in one longitudinal end side of the cleaning container in this embodiment. FIG. 12 is a schematic sectional view showing a state after the injection molding of the resin material on the cleaning container in this embodiment is made.

The vertical seals 15 and 16 as the resin member are disposed symmetrically with respect to the longitudinal direction of the cleaning frame unit 12, so that constitutions relating to the vertical seals 15 and 16 are also symmetrical. Therefore, as the constitutions of the vertical seals 15 and 16, only the one end-side vertical seal 15 is described in some cases but also the vertical seal 16 has the same constitution.

As shown in FIGS. 7, 8 and 9, the cleaning container 13 is provided with an injection port 25 which is a resin injection portion where a melted resin material injected for molding the under-blade seal 14 as the resin member is injected. The injection port 25 is provided in an opposite side of the cleaning container (cleaning container back side) having a contact surface 13*a* to which an under-blade seal mold 50 which is a metal mold provided with a seal shape of the under-blade seal 14 is to be contacted during molding, and communicates with the contact surface 13*a*.

Similarly, the cleaning container 13 is provided with injection ports 26 and 27 for permitting molding of the vertical seals 15 and 16 at longitudinal end portions of the cleaning container 13. The injection ports 26 and 27 are provided in an opposite side of the cleaning container having contact surfaces 13*b* and 13*c* to which vertical seal molds 51 and 52 which are metal molds provided with seal shapes of the vertical seals 15 and 16 are to be contacted during molding, and communicate with the contact surfaces 13*b* and 13*c*, respectively.

Similarly, the cleaning container 13 is provided with injection ports 28*a* and 28*b* for permitting molding of the fixing member 17 as the recording material. The injection ports 28*a* and 28*b* are provided in an opposite side of the cleaning container having a contact surface 13*d* to which a fixing member mold 53 which is a metal mold provided with a shape of the fixing member 17 is to be contacted during molding, and communicates with the contact surface 13*d*.

Similarly, the cleaning container 13 is provided with an injection port 29, communicating with a contact surface 13*e*, to which an electrode member mold 54 which is a metal mold provided with a shape of the electrode member 18 in one longitudinal end portion of the cleaning container 13 is to be contacted during molding.

In this embodiment, the injection port 25 for the under-blade seal 14, the injection ports 26 and 27 for the vertical seals 15 and 16, the injection ports 28*a* and 28*b* for the fixing member 17 and the injection port 29 for the electrode member 18 are provided in the same direction side of the cleaning container 13. Further, gates 41, 42, 43, 44*a*, 44*b* and 45 are provided at positions corresponding to positions of the injection ports 25, 26, 27, 28*a*, 28*b* and 29, respectively, so that ejection directions are the same as open directions of the respective injection ports. This will be described later in detail.

In this embodiment, the injection ports 25, 26, 27, 28*a*, 28*b* and 29 provided on the cleaning container 13 are disposed so that they are different in position with respect to the longitudinal direction of the cleaning container 13 (so that they do not overlap with each other) and thus they are deviated from each other with respect to the longitudinal direction of the cleaning container 13.

Further, in this embodiment, the injection port 25 of the under-blade seal 14 is provided on the contact surface 13*a* with the under-blade seal 14 at a longitudinal central portion. Further, the injection ports 28*a* and 28*b* of the fixing member 17 are provided at two positions so that flowing lengths of the resin material through the injection ports are equal with respect to the longitudinal direction of the contact surface 13*d* with the fixing member 17.

Also the injection port 25 of the under-blade seal 14 may be provided at two or more positions so that flowing lengths of the injected resin material are equal. In this case, a longitudinal position of the cleaning container 13 may preferably be located at a position deviated from other positions (mutually deviated positions).

In this embodiment, the contact surface 13*d* with the fixing member 17 is a surface parallel to the contact surface 13*a* of the under-blade seal 14 opposite from the fixing member 17.

Next, a molding step will be described.

First, as shown in FIG. 8, the cleaning container 13 is set in the resin material injection device 40. The resin material injection device 40 includes a hopper portion 46 for supplying the resin material to the under-blade seal 14 and the vertical seals 15 and 16, a hopper portion 47 for supplying the resin material to the fixing member 17 and a hopper portion 48 for supplying the resin material to the electrode member 18. In this case, as shown in FIG. 9, the under-blade seal mold 50 is clamped to the contact surface 13*a* in a state in which it is contacted to the contact surface 13*a* with the under-blade seal 14. Similarly, the vertical seal molds 51 and 52 are contacted and clamped to the contact surfaces 13*b* and 13*c* with the vertical seals 15 and 16. The fixing member mold 53 is contacted and clamped to the contact surface 13*d* with the fixing member 17. Further, as shown in FIG. 10, the electrode member mold 54 is contacted and clamped to the contact surface 13*e* with the electrode member 18.

The respective molds 50, 51, 52, 53 and 54 may be successively contacted and clamped to the cleaning container 13 or may also be concurrently contacted and clamped to the cleaning container 13. Each of the molds 50, 51, 52, 53 and 54 is in the contact state so as to cause the leakage of the resin material in an injection step described later.

Here, as shown in FIG. 9, the contact surface 13*a* of the under-blade seal 14 and the contact surface 13*d* of the fixing member 17 which are contacted to the under-blade seal mold 50 and the fixing member mold 53, respectively, of the cleaning container 13 are provided as parallel surfaces as described above. As a result, a direction in which a force received by the contact surface 13*a* of the under-blade seal 14 to which the under-blade seal mold 50 is clamped and a direction in which a force received by the contact surface 13*d* of the fixing member 17 to which the fixing member mold 53 is clamped are the same direction. Thus, it is possible to suppress such a deformation of the cleaning container 13 such that the cleaning container 13 is compressed in an inside direction or expanded in an outside direction during the mold clamping in the molding step. Therefore, the under-blade seal mold 50 and the fixing member mold 53 can be contacted to the cleaning container 13 with a good balance, so that the contact state of the cleaning container 13 with each of the molds can be made good. As a result, it is possible to realize the assembling with high accuracy.

Similarly, also the contact surfaces 13*b* and 13*c* of the vertical seals 15 and 16 of the cleaning container 13 are provided so as to parallel to each other. As a result, a direction in which a force received by the contact surface 13*b* of the vertical seal 15 to which the vertical seal mold 51 is clamped and a direction in which a force received by the contact surface 13*c* of the vertical seal 16 to which the vertical seal mold 52 is clamped are the same direction. Thus, it is possible to suppress such a deformation of the cleaning container 13 such that the cleaning container 13 is compressed in an inside direction or expanded in an outside direction during the mold clamping in the molding step. Therefore, the vertical seal mold 51 and 52 can be contacted to the cleaning container 13 with a good balance, so that the contact state of the cleaning container 13 with each of the molds can be made good. As a result, it is possible to realize the assembling with high accuracy.

Then, to the injection ports 25, 26, 27, 28*a*, 28*b* and 29 provided on the cleaning container 13, the gates 41, 42, 43, 44*a*, 44*b* and 45 of the resin material injection device 40 are contacted, respectively, from above in the vertical direction as shown in FIG. 7. In this embodiment, the respective injection ports are disposed in the same direction side of the cleaning container 13, and the contact surfaces 13*a*, 13*b*, 13*c*, 13*d* and 13*e* are disposed in the same direction side of the cleaning container 13. As a result, a plurality of parts can be concurrently molded in the same step and thus it is possible to realize a reduction in number of assembling steps without decreasing the number of the parts and shortening of a part-molding time (tact time) of a plurality of part-molding steps themselves, so that it becomes possible to realize a reduction in product cost by an increase in manufacturing efficiency and the reduction in number of the assembling steps. Further, the gates 41, 42, 43, 44*a* and 44*b* and 45 can be contacted to the cleaning container 13 at the same time and thus injection operations can be concurrently effected, so that injection end times of all of the parts can be shortened.

Further, when the injection ports 25, 26, 27, 28*a*, 28*b* and 29 are viewed from a direction parallel to the cartridges 13*a* to 13*e*, the injection ports 25 to 29 are disposed at mutually deviated positions with respect to the longitudinal direction of the cleaning container 13. As a result, it is possible to avoid mutual interference of the gates 41, 42, 43, 44*a*, 44*b* and 45 of the resin material injection device 40, so that the cleaning container 13 (process cartridge B) can be downsized irrespective of the device constitution.

Then, plungers 55, 56 and 57 of the resin material injection device 40 are driven in an arrow direction shown in FIG. 9, so that the elastomer resin material as the seal material for the under-blade seal 14 and the vertical seals 15 and 16 are injected from the gates 41, 42 and 43. The injected elastomer resin material is caused to flow into a space defined by the cleaning container 13, the under-blade seal mold 50 and the vertical seal molds 51 and 52.

Similarly, plunger 58 of the resin material injection device 40 are driven in an arrow direction shown in FIG. 9, so that the elastomer resin material as the material for the fixing member 17 is injected from the gates 44*a* and 44*b*. The injected elastomer resin material is caused to flow into a space defined by the cleaning container 13 and the fixing member mold 53.

Similarly, a plunger 59 of the resin material injection device 40 are driven in an arrow direction shown in FIG. 10, so that the elastomer resin material as the material for the electrode member 18 as the resin member is injected from the gate 54. The injected elastomer resin material is caused to flow into a space defined by the cleaning container 13 and the electrode member mold 54.

The under-blade seal 14, the vertical seals 15 and 16, the fixing member 17 and the electrode member 18 may be molded by successively injecting the elastomer resin materials from the associated gates but by employing a constitution in which the resin materials are concurrently injected from the gates, it is possible to effect the injection operations at the same time.

In this embodiment, as described above, the gates 41, 42, 43, 44*a*, 44*b* and 45 of the resin material injection device 40 are configured to be concurrently contacted to the injection ports 25, 26, 27, 28*a*, 28*b* and 29, so that the resin materials can be injected at the same time. Thus, in this embodiment, a constitution in which the injection end time of all the parts can be shortened is employed.

After the injection, the cleaning container 13 is taken cut. At this time, as shown in FIGS. 11 and 12, the cleaning container 13 is retracted from the gates 41, 42, 43, 44*a*, 44*b* and 45 of the resin material injection device 40. Then, as shown in FIG. 11, the gate 45 of the resin material injection device 40 and the electrode member mold 54 are retracted from the cleaning container 13. Then, as shown in FIG. 12, the cleaning container 13 is retracted in an arrow R direction from the under-blade seal mold 50, the vertical seal molds 51 and 52 and the fixing member mold 53. The arrow R direction is a parting direction in which there is no undercut portion with respect to shapes of the molded under-blade seal 14 and the molded fixing member 17, thus being different from a parting direction of the cleaning container 13 (the up-down direction in FIG. 12). Then, in a state in which the under-blade seal 14, the vertical seals 15 and 16, the fixing member 17 and the electrode member 18 are molded on the cleaning container 13, the cleaning container 13 is retracted, so that the cleaning container 13 can be taken out.

According to this embodiment, by the molding step as described above, the under-blade seal 14, the vertical seals 15 and 16, the fixing member 17 and the electrode member 18 can be integrally molded. As a result, the under-blade seal 14, the vertical seals 15 and 16, the fixing member 17 and the electrode member 18 can be provided on the cleaning container 13 with high accuracy, so that also the automatic machine can effect high-accuracy and easy assembling and thus stabilization of product function can be realized.

Thus, according to this embodiment, the plurality of parts (members) such as the under-blade seal 14, the vertical seals 15 and 16, the fixing member 17 and the electrode member 18 can be manufactured in the same step by using the above-described resin material injection device 40. Further, the plurality of parts, molded with the resin materials different from the resin material for the cleaning container 13, such as the under-blade seal 14, the vertical seals 15 and 16, the fixing member 17 and the electrode member 18 can be manufactured in the same step. That is, the plurality of parts different in function can be manufactured in the same step, so that a reduction in assembling step, an increase in manufacturing efficiency thereby, and a reduction in product cost by the reduction in assembling step can be realized. Further, even with respect to a shape, for which it is difficult to manufacture by a conventional general two-color molding, such as the curvature shape of an end portion of a member different in parting direction from the cleaning container 13, a plurality of members can be integrally molded and taken out.

In this embodiment, as the plurality of members molded on the cleaning container 13, a combination of the under-blade seal 14, the vertical seals 15 and 16, the fixing member 17 and the electrode member 18 (5 parts with 3 types of the resin materials) is used that the plurality of members are not limited thereto. That is, the plurality of members may also be a combination of the seal member (at least one of the under-blade seal 14 and the vertical seals 15 and 16) and the fixing member 17 having a sealing function, a combination of the seal member and the electrode member 18 and a combination of the fixing member 17 and the electrode member 18.

Further, the 3 types of the resin materials are used for the 5 parts but the number of the resin materials is not limited thereto. With respect to the 5 parts, 2 or 5 types of the resin materials may also be used. At least one of the plurality of members may only be required to be molded with a resin material different from that for another member of the plurality of members.

Further, in this embodiment, the plurality of molds corresponding to the plurality of members are disposed in the same direction side of the cleaning container 13 during the molding so that the plurality of surfaces, i.e., the contact surfaces 13*a*, 13*b*, 13*c*, 13*d* and 13*e* are disposed in the same direction side of the cleaning container 13 but the present invention is not limited thereto. Of the plurality of contact surfaces, at least two contact surfaces are only required to be disposed in the same direction side of the cleaning container 13. As a result, at least two members can be concurrently molded in the same step. Thus, it is possible to realize the reduction in number of assembling steps without decreasing the number of the parts and the shortening of the part-molding time (tact time) of the plurality of part-molding steps themselves, so that it becomes possible to realize the increase in manufacturing efficiency and the product cost reduction by the assembling step reduction. Further, at least two gates can be concurrently contacted to the cleaning container 13 and thus can effect the injection operations at the same time, so that the injection end time of all the parts can be shortened.

Further, in this embodiment, the contact surfaces 13*a* and 13*d* are configured to be the parallel surfaces, and also the contact surfaces 13*b* and 13*c* are configured to be the parallel surfaces but the present invention is not limited thereto. That is, of the plurality of contact surfaces to which the plurality of molds corresponding to the plurality of members are contacted during molding, at least two contact surfaces disposed in the same direction side of the cleaning container 13 may only be required to be configured to be parallel to each other. As a result, during the clamping in the molding step, the directions of the forces received by the cleaning container 13 by the clamping can be made the same direction, so that the deformation of the cleaning container 13 such that the cleaning container 13 is compressed in the inside direction or expanded in the outside direction can be suppressed. Therefore, the plurality of molds can be contacted to the cleaning container 13 with a good balance, so that the contact state of the cleaning container 13 with each of the mold can be made good. In this embodiment, the formation of the parallel surfaces by at least two contact surfaces (e.g., the contact surfaces 13*a* and 13*d*) is described. However, the parallel surfaces may also be formed by all or part of the mold contact surfaces.

Further, in this embodiment, the injection ports 25, 26, 27, 28*a*, 28*b* and 29 are provided in the opposite side of the cleaning container 13 from the contact surfaces 13*a* to 13*e* to which the corresponding molds are contacted during the molding but the present invention is not limited thereto. That is, the injection ports may only be required to be provided in the opposite side of the cleaning container 13 from at least two surfaces, of the contact surfaces to which the plurality of molds corresponding to the plurality of members are contacted during the molding, disposed in the same direction side of the cleaning container 13. In the case where the injection port is provided on the surface of the cleaning container 13 to which the mold is to be contacted, there is a need to provide a resin material injection means inside the mold and thus there is a possibility of a complicated mold. On the other hand, by providing the injection port in the opposite side from the contact surface to which the mold is to be contacted, the constitution of the mold can be simplified, so that the product cost can be reduced.

In this embodiment, the photosensitive drum unit 11 is described but the present invention is suitably applicable to also the developing unit 10. Although details will be described later, the developing unit 10 may also be constituted as the process cartridge in which at least two of the seal member, the fixing member and the electrode member which are used as the plurality of members disposed on the frame constituting the developing unit 10 are integrally molded. Also in such a constitution, an effect similar to that in this embodiment can be obtained.

Embodiment 2

Embodiment 2 will be described. In this embodiment, a constitution portion different from that in Embodiment 1 described above will be described and a similar constitution portion will be omitted from description thereof.

Figure 13:
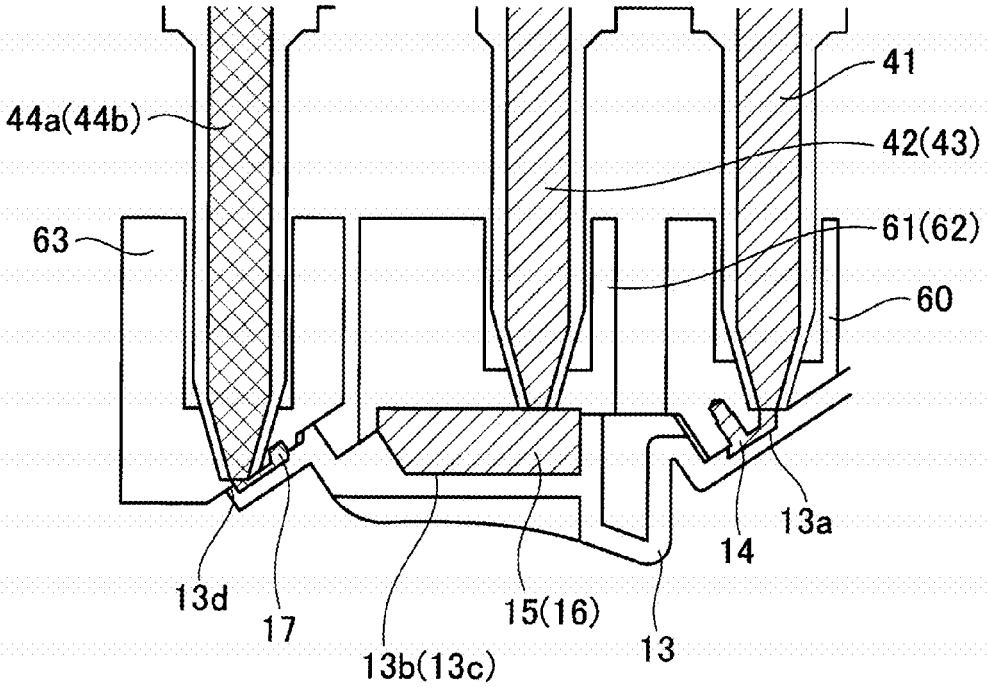
FIG. 13 is a schematic sectional view showing a state in which injection molding resin materials is effected in a longitudinal end side of a cleaning container in Embodiment 2.
Figure 14:
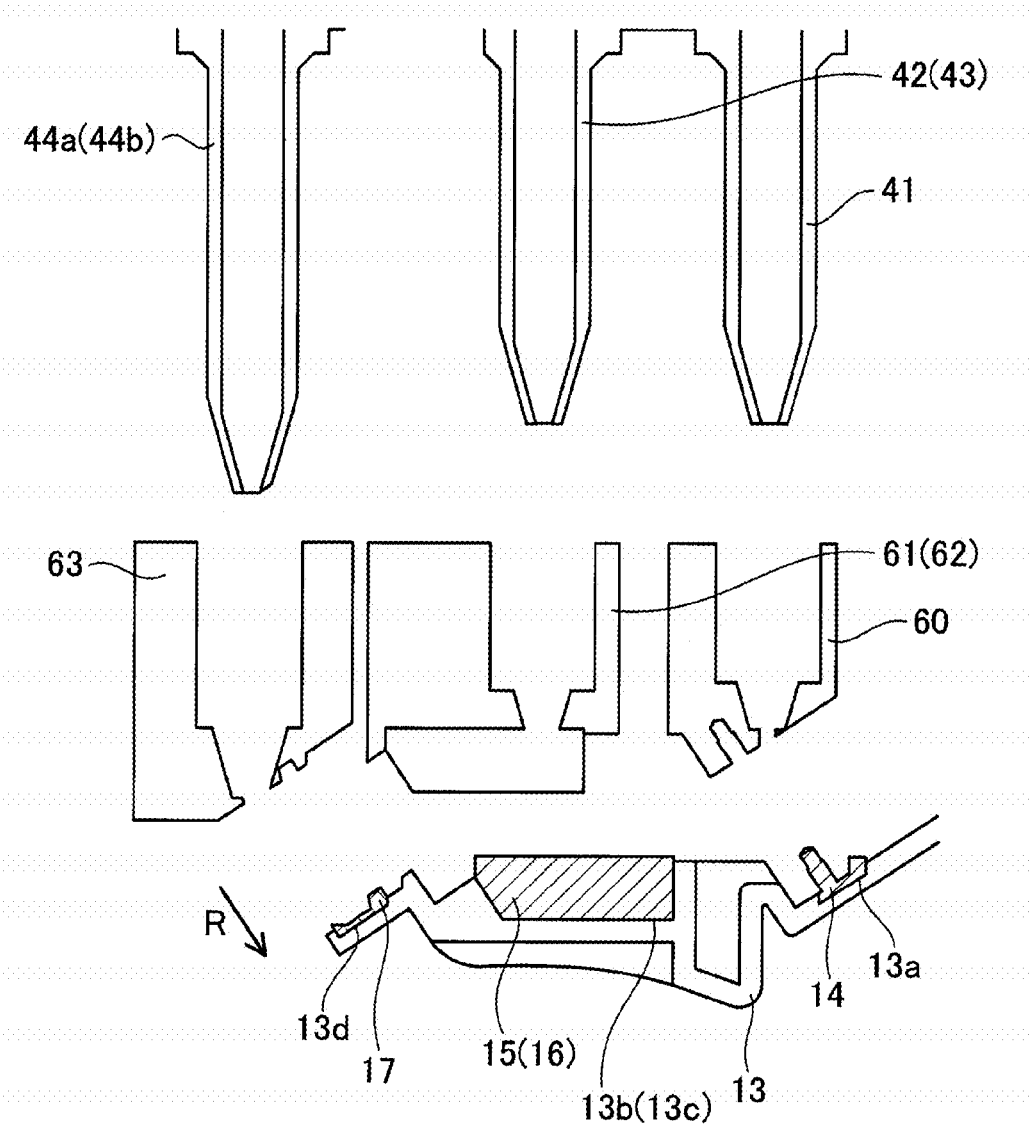
FIG. 14 is a schematic sectional view showing a state after the injection molding of the resin materials is effected in the longitudinal end side of the cleaning container in Embodiment 2.

FIG. 13 is a schematic sectional view showing a state in which the resin materials are injected for molding into the cleaning container, and FIG. 14 is a schematic sectional view showing a state in which the resin materials are injected for molding into the cleaning container.

In this embodiment, a constitution in which the resin materials are directly injected for molding from the mold contact surface side of the cleaning container 13 into the cleaning container 13 to form the plurality of members is employed. By employing such a constitution, the plurality of members are provided with injection ports (gates) into which the resin materials are to be directly injected from the molds when they are molded. A form in which the resin materials are directly injected from the molds may include a form in which the resin materials are injected from the gates of the resin material injection device 40 via the molds and a form in which the resin materials are directly injected from the gates of the resin material injection device 40 mounted to the molds.

In this embodiment, an under-blade seal mold 60 is provided with a seal shape of an under-(cleaning) blade seal 14 and a mounting portion to which a gate 41 is to be mounted (or inserted). Further, vertical seal molds 61 and 62 are provided with seal shapes of vertical seals 15 and 16 and mounting portions to which gates 42 and 43 are to be mounted. Further, a fixing member mold 63 is provided with a shape of the fixing member 17 and mounting portions to which gates 44*a* and 44*b* are to be mounted.

Next, a molding step will be described.

First, the cleaning container 13 is set in the resin material injection device 40. In this embodiment, as shown in FIG. 13, the cleaning container 13 is set in the resin material injection device 40 via the under-blade seal mold 60, the vertical seal molds 61 and 62 and the fixing member mold 63.

In this case, first, the under-blade seal mold 60, the vertical seal molds 61 and 62 and the fixing member mold 63 are contacted to the mold contact surfaces 13*a*, 13*b*, 13*c* and 13*d*, respectively, of the cleaning container 13. Therefore, the gates 41, 42, 43, 44*a* and 44*b* of the resin material injection device 40 are contacted to the under-blade seal mold 60, the vertical seal molds 61 and 62, and the fixing member mold 63 from the same direction side as the side where the molds are contacted to the cleaning container 13. In a state in which the cleaning container 13 is set in the resin material injection device 40, similarly as in Embodiment 1, the gates 41, 42, 43, 44*a* and 44*b* are provided in the same direction side with respect to the cleaning container 13.

The elastomer resin materials are injected from the mold contact surfaces 13*a*, 13*b*, 13*c* and 13*d* to which the under-blade seal mold 60, the vertical seal molds 61 and 62 and the fixing member mold 63 are contacted, respectively, into spaces defined by the respective molds and the cleaning container 13.

After the injection, the cleaning container 13 is taken cut. At this time, as shown in FIG. 14, the cleaning container 13 is retracted from the gates 41, 42, 43, 44*a* and 44*b* of the resin material injection device 40 (downward in FIG. 14). Then, the cleaning container 13 is retracted in an arrow R direction from the under-blade seal mold 60, the vertical seal molds 61 and 62 and the fixing member mold 63. The arrow R direction is a parting direction in which there is no undercut portion with respect to shapes of the molded under-blade seal 14 and the molded fixing member 17, thus being different from a parting direction of the cleaning container 13 (the up-down direction in FIG. 14). Thus, by retracting the cleaning container 13 in an arrow R direction, in a state in which the under-blade seal 14, the vertical seals 15 and 16, the fixing member 17 and the electrode member 18 are molded on the cleaning container 13, the cleaning container 13 can be taken out.

In the constitution of Embodiment 2, the resin material is injected from the side, where the molds are contacted to the cleaning container 13, to effect the molding and therefore the injection ports as the resin material injection portions as described in Embodiment 1 are not provided on the cleaning container 13. In such a developer, there is no need to ensure a space in which the injection ports are provided in the opposite side of the cleaning container 13 from the mold contact surfaces, so that the cleaning container 13 can be downsized.

In this embodiment, the resin materials are injected for molding from the side where the mold contact surfaces 13*a*, 13*b*, 13*c*, 13*d* and 13*e* of the cleaning container 13 are provided, so that the plurality of members are formed but the present invention is not limited thereto. Members molded by using molds corresponding to at least two surfaces, of the plurality of mold contact surfaces, provided in the same direction side of the cleaning container 13 may only be required to be molded by injecting the resin materials from the same direction side via the molds during the molding.

Embodiment 3

Figure 15:
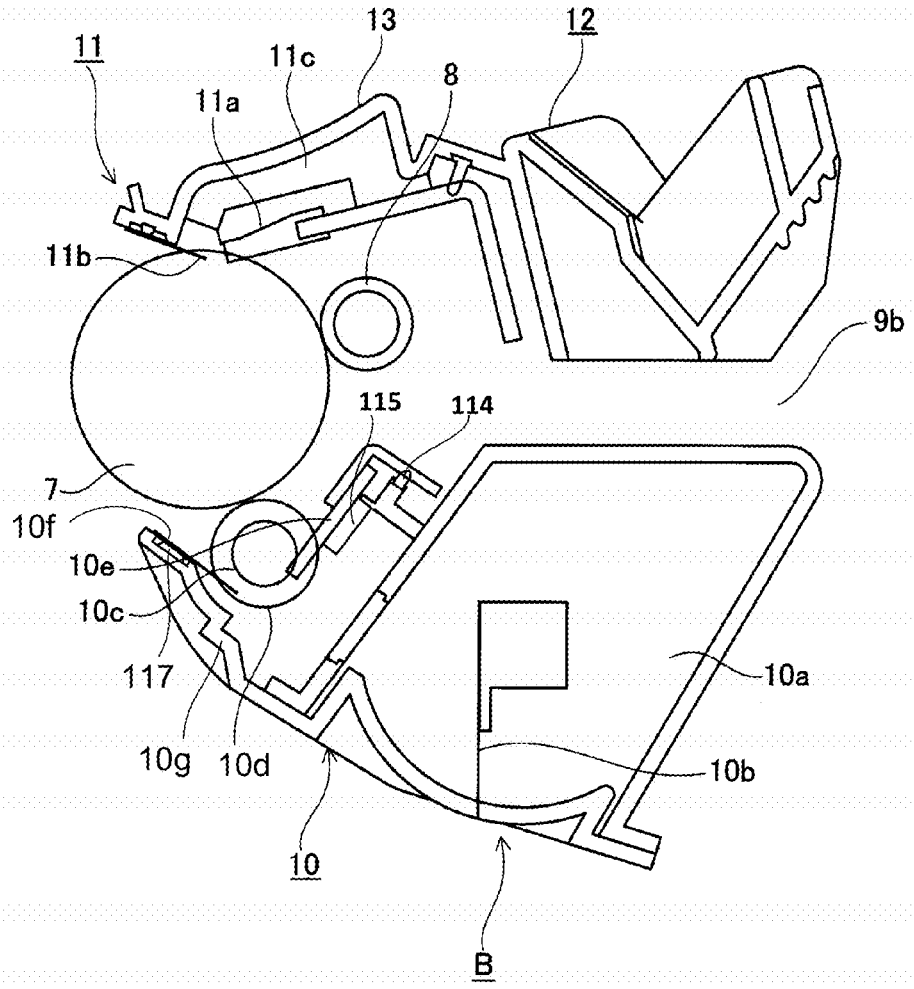
FIG. 15 is a schematic sectional view of a process cartridge in Embodiment 3.

FIG. 15 is a schematic sectional view of a process cartridge in Embodiment 3. In this embodiment, a constitution portion different from that in Embodiments 1 and 2 described above will be described and a similar constitution portion will be omitted from description thereof.

In Embodiment 1 described above, the example in which the under-blade seal 14, the vertical seals 15 and 16, the fixing member 17 and the electrode member 18 are provided in the photosensitive drum unit 11 by using the elastomer resin materials. However, these members may also be provided in the developing unit 10.

That is, the above members may also be members, for preventing the toner from leaking out from a gap between a developing blade 10*e* and a developing frame 10*g* constituting a toner accommodating portion a of the developing unit 10, such as an under-blade seal 114 extending in the longitudinal direction of the developing unit 10 and a vertical seal 115 provided at longitudinal end portions of the developing unit 10. Further, the members may also be a fixing member 117 for fixing, on the developing frame 10*g*, a leakage preventing sheet 10*f* contacted to a developing roller 10*d* as a thin plate member (process means) and may also be an electrode member for supplying electric energy to the developing roller 10*d* or the develop blade 10*e*. The fixing member 117 also has a function as a seal member for preventing the toner from leaking out from a gap between the developing frame 10*g* and the leakage preventing sheet 10*f*.

As described above, according to the present invention, it becomes possible to improve the assembling property when the resin members are assembled with the cartridge frame by the automatic machine and to realize the assembling with high accuracy.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 245733/2011 filed Nov. 9, 2011 and 270107/2011 filed Dec. 9, 2011, which are hereby incorporated by reference.

What is claimed is:

1. A cartridge detachably mountable to a main assembly of an image forming apparatus, the cartridge comprising:

a cartridge frame formed of a first resin material, and a resin member formed of a second resin material that is different from the first resin material, wherein the cartridge frame includes (i) a first surface with which a metal mold contacts so as to form a molding space between the first surface and the metal mold and on which an outlet port is provided in the molding space, (ii) a second surface that is opposite to the first surface and on which an inlet port is provided, and (iii) a straight passage straightly penetrating the cartridge frame from the inlet port to the outlet port, and wherein the resin member is molded on the cartridge frame by the second resin material being injected from the inlet port into the molding space through the outlet port.

2. A cartridge according to claim 1, further comprising a plurality of first surfaces, wherein the first surfaces are provided in parallel.

3. A cartridge according to claim 1, wherein the resin member includes a plurality of members in which at least one of the plurality of members and another one of the plurality of members are molded with different materials.

4. A cartridge according to claim 1, further comprising:

a process member acting on an electrophotographic photosensitive member; and an accommodating portion for accommodating developer, wherein the resin member includes a plurality of seal members for preventing the developer from leaking out of the cartridge.

5. A cartridge according to claim 4, wherein the process member includes a cleaning member for removing developer from the electrophotographic photosensitive member and a sheet member for preventing developer from leaking out of the accommodating portion, with the sheet member contacting the electrophotographic photosensitive member, and wherein the resin member includes at least two members selected from a first seal member for sealing a gap between the cleaning member and the cartridge frame along a longitudinal direction of the cleaning member, a second seal member for sealing a gap between the cleaning member and the cartridge frame along a widthwise direction of the cleaning member perpendicular to the longitudinal direction of the cleaning member, and a fixing member for fixing the sheet member on the cartridge frame.

6. A cartridge according to claim 4, wherein the process member is a developing roller for developing an electrostatic latent image formed on the electrophotographic photosensitive member with developer.

7. A cartridge according to claim 4, wherein the process member includes a cleaning member for removing developer from the electrophotographic photosensitive member and a sheet member for preventing developer from leaking out of the accommodating portion, the sheet member contacting with the electrophotographic photosensitive member, and wherein at least one of the seal members includes at least one member selected from a first seal member for sealing a gap between the cleaning member and the cartridge frame along a longitudinal direction of the cleaning member, a second seal member for sealing a gap between the cleaning member and the cartridge frame along a widthwise direction of the cleaning member perpendicular to the longitudinal direction of the cleaning member, and a fixing member for fixing the sheet member on the cartridge frame.

8. A cartridge according to claim 1, further comprising:

a process member acting on an electrophotographic photosensitive member; and an accommodating portion for accommodating developer, wherein the resin member is a seal member for preventing developer from leaking out of the cartridge and an electrode member for supplying electric energy from the image forming apparatus main assembly to the process member.

9. A cartridge according to claim 8, wherein the electrode member is a member for supplying electrical energy to a charging member, which is the process member, for electrically charging the electrophotographic photosensitive member.

10. A cartridge according to claim 8, wherein the process member is a developing roller for developing an electrostatic latent image formed on the electrophotographic photosensitive member with developer.

11. A unit for use with an electrophotographic image forming apparatus, the unit comprising:

a cartridge frame formed of a first resin material;

a cleaning member, mounted on the cartridge frame, for removing developer from an electrophotographic photosensitive member;

a sheet member contactable to the electrophotographic photosensitive member;

a resin member formed of a second resin material that is different from the first resin material; and an accommodating portion for accommodating developer, wherein the accommodating portion is constituted by the cartridge frame, the cleaning member, the sheet member, and the resin member, wherein the cartridge frame includes (i) a first surface with which a metal mold contacts so as to form a molding space between the first surface and the metal mold and on which an outlet port is provided in the molding space, (ii) a second surface opposite to the first surface and on which an inlet port is provided, and (iii)

a straight passage straightly penetrating the cartridge frame from the inlet port to the outlet port, and wherein the resin member is molded on the cartridge frame by the second resin material being injected from the inlet port into the molding space through the outlet port.

12. A unit according to claim 11, wherein the resin member includes a plurality of members, and wherein the first surface includes a plurality of first surfaces, provided in parallel, for forming the plurality of members.

13. A unit according to claim 11, wherein the resin member includes a plurality of members in which at least one of the members and another one of the members are molded with different materials.

14. A unit according to claim 11, wherein the resin member includes at least two members selected from a first seal member for sealing a gap between the cleaning member and the cartridge frame along a longitudinal direction of the cleaning member, a second seal member for sealing a gap between the cleaning member and the cartridge frame along a widthwise direction of the cleaning member perpendicular to the longitudinal direction of the cleaning member, and a fixing member for fixing the sheet member on the cartridge frame.

* * * * *